US012649554B1

(12) United States Patent
Gieseke

(10) Patent No.: US 12,649,554 B1
(45) Date of Patent: Jun. 9, 2026

(54) THERMALLY CONTROLLED BUOYANCY DEVICE

(71) Applicant: The United States of America, as represented by the Secretary of the Navy, Newport, RI (US)

(72) Inventor: Thomas J. Gieseke, Dighton, MA (US)

(73) Assignee: The United States of America as represented by the Secretary of the Navy

( * ) Notice: Subject to any disclaimer, the term of this patent is extended or adjusted under 35 U.S.C. 154(b) by 299 days.

(21) Appl. No.: 18/647,616

(22) Filed: Apr. 26, 2024

(51) Int. Cl.
*B63G 8/24* (2006.01)

(52) U.S. Cl.
CPC ..... *B63G 8/24* (2013.01)

(58) Field of Classification Search
CPC ..... B63G 8/00; B63G 8/08; B63G 8/24
See application file for complete search history.

(56) References Cited

U.S. PATENT DOCUMENTS

2006/0096315 A1* 5/2006 Roth ..... F25B 41/335 62/527
2021/0331774 A1* 10/2021 Lautrup ..... G01S 15/93

FOREIGN PATENT DOCUMENTS

EP 2368062 B1 * 6/2012 ..... F16K 31/002

* cited by examiner

*Primary Examiner* — Stephen P Avila
(74) *Attorney, Agent, or Firm* — James M. Kasischke; Jeffry C. Severson

(57) ABSTRACT

A thermally controlled buoyancy device is provided with a bi-metallic structure that, when heated, causes volume changes and resulting changes in the buoyancy of the device. The buoyancy device includes an electrical source, a pressure sensor, an electronic controller and at least one variable buoyancy cell with a tunable internal volume. The buoyancy cells include laminated materials with differing coefficients of thermal expansion such that when heated can change shape and volume. The device controls buoyancy by monitoring the depth and supplying that signal to the controller. If the pressure exceeds the pre-set depth pressure; the controller passes current to a heating element in the buoyancy cell. The buoyancy cell responds to the current by increasing volume and thus increasing buoyancy. The design can be inverted such that heating causes the thermally controlled buoyancy device to shrink and lose buoyancy.

4 Claims, 3 Drawing Sheets

THERMALLY CONTROLLED BUOYANCY DEVICE

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER PATENT APPLICATIONS

None.

BACKGROUND OF THE INVENTION

(1) Field of the Invention

The present invention relates to a buoyancy device in which the volume of the buoyancy device is controlled by temperature adjustment of outer walls of the buoyancy device.

(2) Description of the Prior Art

A number of applications exist to control the buoyancy of a submerged device. This control may be needed to maintain a specific buoyant force imparted on an underwater object or to maintain the depth of a submerged object by actively controlling buoyant forces. For example: SCUBA divers require active buoyancy control to maintain depth by using compressed air to inflate buoyancy vests; however, control is manually maintained by adding and venting air. Novice divers and divers who regularly change depth want buoyancy to be automatically maintained.

Undersea vehicles maintain depth by using compressed air which is added to and vented from ballast tanks or the undersea vehicles use thrusters and control surfaces to maintain depth. In these cases, devices are employed wherein a few large systems control the buoyancy of the overall system. In situations where the structure may be large and flexible; buoyancy devices are distributed on the structure to provide uniform floating or sinking forces. For example, a buoyant cable (either positively or negatively buoyant) that must be suspended at a given depth will require a distributed set of buoyancy control devices distributed along a length of the cable.

Bi-metallic structures are well known in the prior art to create stresses in materials that lead to deformation. Bi-metallic structures are created when two materials with differing coefficients of thermal expansion are laminated together. When these composite structures are heated or cooled; the metals expand differently due to the differences in coefficients of thermal expansion. The resulting stress causes structural deformations.

A need exists for a buoyancy device in which the volume of the device can be automatically controlled in order to manipulate the buoyancy of the device. Additionally, and due to their simplicity, bi-metallic structures should be used to achieve the desired buoyancy of the device.

SUMMARY OF THE INVENTION

It is therefore an object of the present invention to provide a buoyancy control device that employs a bi-metallic structure that when heated causes volume changes and resultant changes in device buoyancy.

Other objects and advantages of the present invention will be apparent from the following description in which a thermally controlled buoyancy device is provided with a first shell having a concave inner surface and a convex outer surface as well as a first coefficient of thermal expansion. The first shell has a thickness, a cross sectional shape of a portion of a symmetric bell curve, a longitudinal extent, a first flattened end, a second flattened end and a peripheral edge lying in a plane.

A second shell is provided that has an inner concave surface and an outer convex surface as well as a second coefficient of thermal expansion. The second shell includes a thickness, a cross sectional shape of a circular arc with a center of symmetry and a longitudinal extent. The inner surface of the second shell is bonded to the outer surface of the first shell. The second shell aligns longitudinally with the first shell and a center of symmetry of the first shell aligns with a center of symmetry of the second shell.

A third shell and a fourth shell identical to the first shell and the second shell are provided but are flipped about the periphery plane. The third shell positioned with the concave inner surface of the third shell facing the concave inner surface of the first shell with a peripheral edge of the third shell is bonded to a peripheral edge of the first shell to form a volume between the first shell and the third shell.

A heating element is bonded to the inner concave surface of the first shell and the inner concave surface of the third shell. The first and second shells and the third and fourth shells have a first position responsive to the temperature of the shells in which a space defined between said first and third shells is minimized. A second position is responsive to the temperature of the shells in which the space defined between the second and third shells is maximized by expansion and contraction of the first shell, the second shell, the third shell and the fourth shell in response to differences in coefficients of thermal expansion.

The thermally controlled buoyancy device may be manufactured with selected materials such that the coefficient of expansion of the second shell and the fourth shell are greater than the coefficient of thermal expansion of the first shell and the third shell. This material selection results in an increase in buoyancy with heating.

The thermally controlled buoyancy device may alternatively be manufactured with selected materials such that the coefficient of expansion of the second shell and the fourth shell is less than the coefficient of thermal expansion of the first shell and the third shell. This material selection results in a decrease in buoyancy with heating.

The thermally controlled buoyancy device is controlled by adjusting current to the heating element by using a control circuit with a sensor reactive to external pressure in which the sensor produces an electric signal. A controller compares a pressure signal (based on the electric signal) to a reference to produce an electric current in response to the difference in the electric signal and the reference.

BRIEF DESCRIPTION OF THE DRAWINGS

A more complete understanding of the invention and many of the attendant advantages thereto will be readily appreciated by reference to the following detailed description in conjunction with the accompanying drawings wherein.

DETAILED DESCRIPTION OF THE INVENTION

Figure 1:
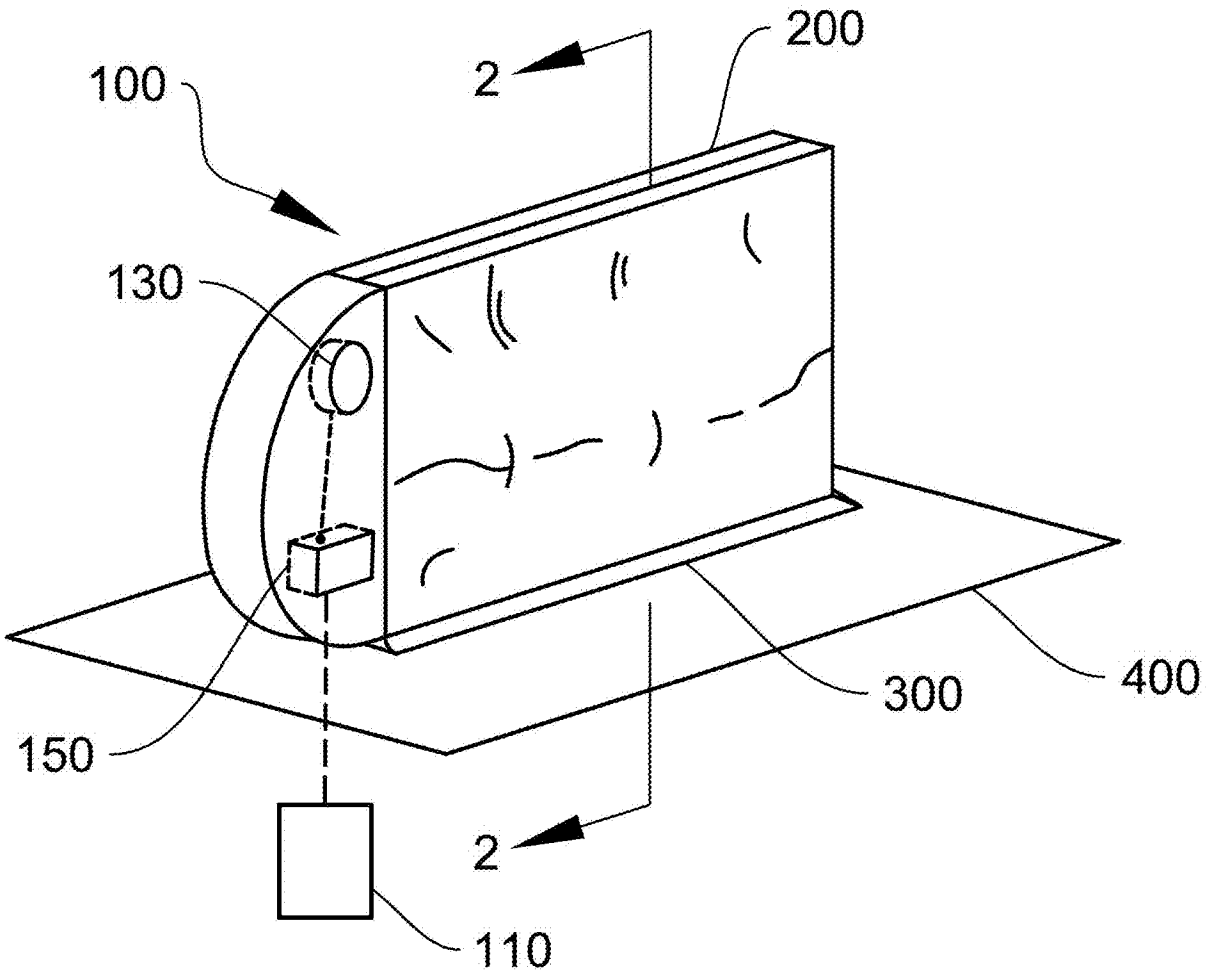
FIG. 1 depicts the thermally controlled buoyancy device of the present invention.

FIG. 1 depicts a thermally controlled buoyancy device 100. The thermally controlled buoyancy device 100 includes an electrical source 110, a pressure sensor 130, an electronic controller 150, at least one variable buoyancy cell 200 with a tunable internal volume and an attachment means 300 to attach these components to a submerged structure 400.

The thermally controlled buoyancy device 100 monitors a depth pressure with the pressure sensor 130 and supplies a signal to the controller 150. If the pressure exceeds or drops below the pre-set depth pressure (i.e. the depth is greater or less than the desired depth); the controller 150 adjusts the current sent to the variable buoyancy cell 200.

The variable buoyancy cell 200 responds to the current by changing volume to increase or decrease buoyancy. The resultant buoyancy forces lift or depress the submerged structure 400 through the attachment means 300 until the pressure sensed by the pressure sensor 130 is close to the pre-set depth pressure. The current is then turned off and the variable buoyancy cell 200 responds by cooling; thereby, changing volume and the resulting buoyancy forces. The submerged structure 400 responds by moving in the water column with the pressure signal changing as a result. This control cycle is optimized using standard proportional-integral-derivative (PID) control techniques in order to minimize instabilities, oscillations and overshooting.

Figure 2:
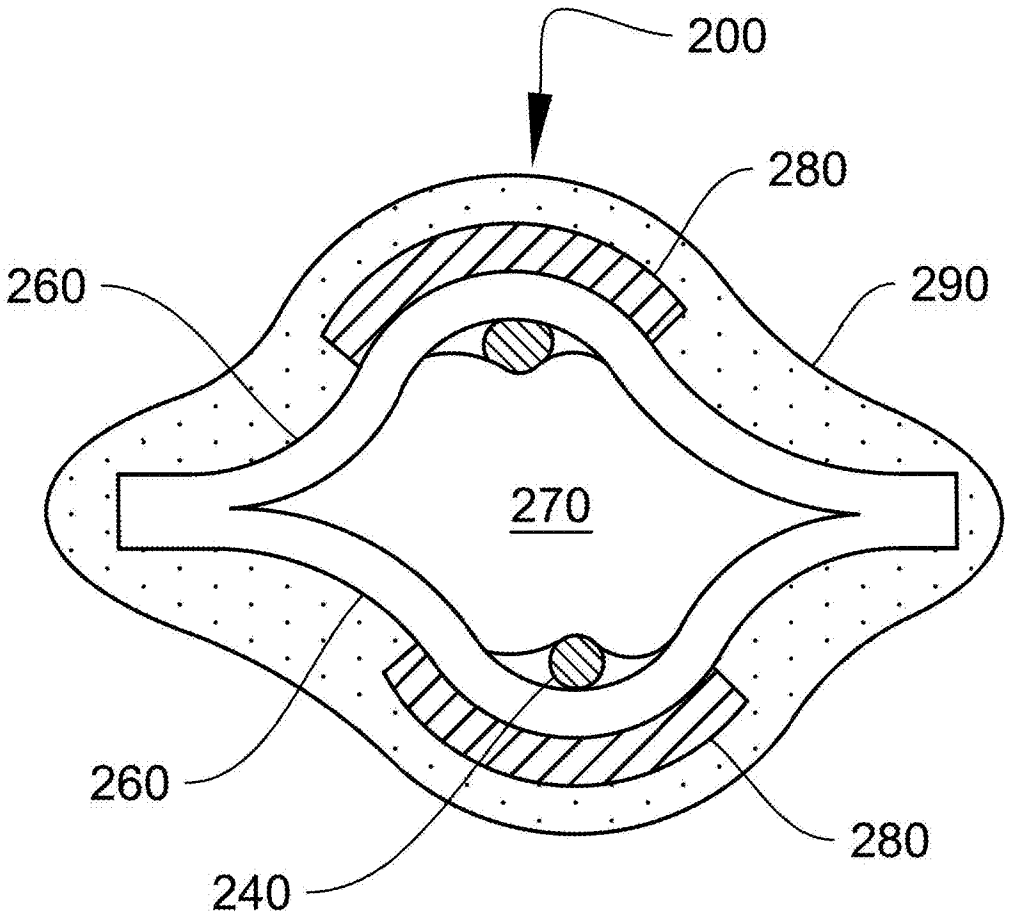
FIG. 2 depicts a cross section of the thermally controlled buoyancy device in a first position.

FIG. 2 depicts a cross section of the variable buoyancy cell 200. A bi-metallic wall structure in the variable buoyancy cell 200 creates the necessary structural changes to supply current for buoyancy changes in response to controller outputs. The variable buoyancy cells 200 are extrusions of two bell-shaped walls 260 (bell-shaped in the shape of a Gaussian curve) with opposing concave surfaces facing each other to create a void 270.

A C-shaped structure 280 (where the C-shape is a portion of a circular arc) is bonded to the external surfaces of the bell-shaped walls 260 by using known adhesive or surface bonding techniques and a heating element 240 is bonded to the internal surfaces of the bell-shaped walls. Insulation 290 is applied to the external surface of the C-shaped structure 280. The material of the C-shaped structure 280 is selected to have a different coefficient of thermal expansion than the material of the bell-shaped walls 260. The edges of the two bell-shaped walls 260 are bonded together and the ends are closed to form a volume.

FIG. 2 depicts the C-shaped structure 280 in an unheated and buoyant state wherein the material of the C-shaped structure 280 has a lower coefficient of thermal expansion than the material of the bell-shaped walls 260. When current is applied to the heating element 240 (associated with a control signal to increase buoyancy) and due to the dissimilar coefficients of thermal expansion; the C-shaped structure 280 expands differently than the bell-shaped walls 260 with a change in curvature of the bonded wall combination.

This curvature results in an increase or decrease in the internal volume of the void 270. If the coefficient of thermal expansion of the C-shaped structure 280 is higher than the coefficient of thermal expansion of the bell-shaped walls 260; the volume of the variable buoyancy cell 200 will increase when heated. If the coefficient of thermal expansion of the C-shaped structure 280 is less than the coefficient of thermal expansion of the bell-shaped walls 260; the volume of the variable buoyancy cell 200 will decrease when heated.

Figure 3:
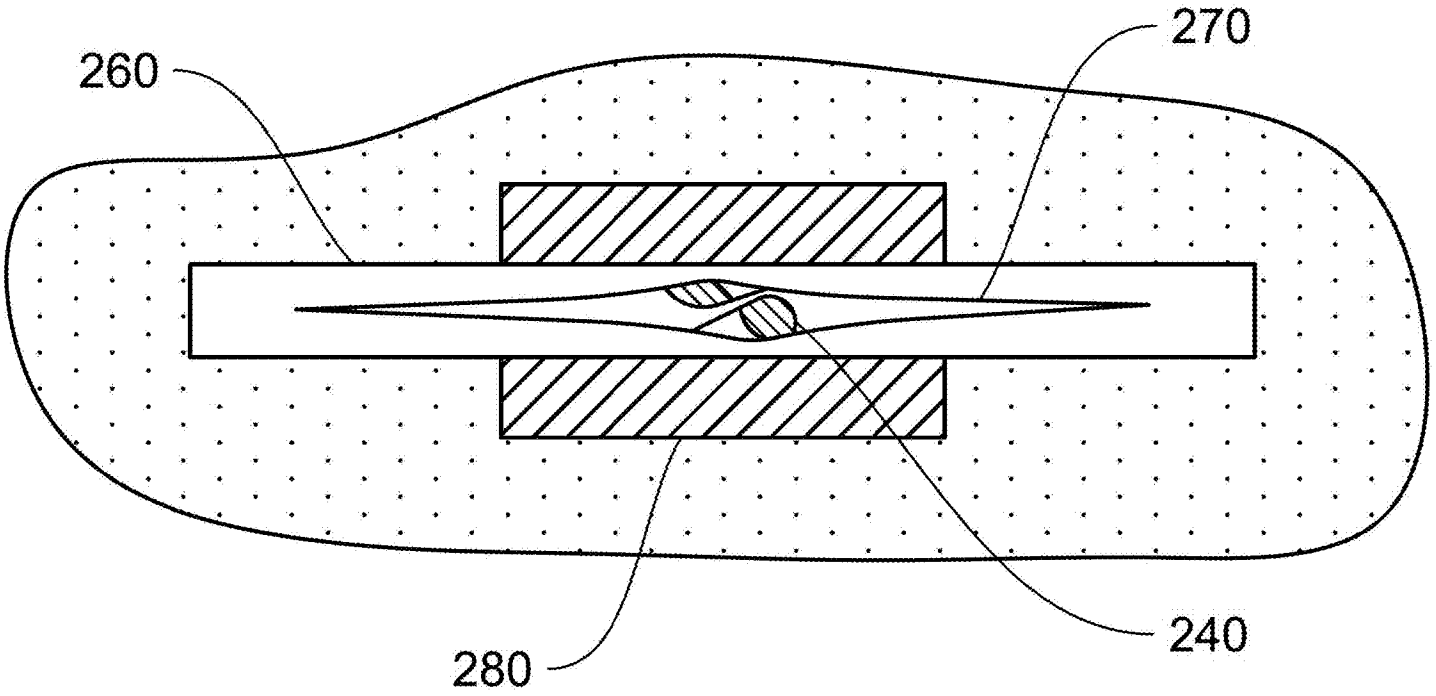
FIG. 3 depicts a cross section of the thermally controlled buoyancy device in a second position.

FIG. 3 depicts the coefficient of thermal expansion of the C-shaped structure 280 less than the coefficient of thermal expansion of the bell-shaped wall 260 and current is passed through the heating element 240. In the figure, the buoyancy control device 100 has been heated as a result of increased current in the heating element 282. The C-shaped structure 280 has expanded less than the bell-shaped walls 260; the buoyancy device 100 has flattened, and the volume of the variable buoyancy cell 200 has decreased.

When current from the heating element 240 decreases; the C-shaped structure 280 cools and shrinks less than the bell-shaped wall 260. The difference in expansion of the bell-shaped walls 260 results in a change in curvature of the bonded walls and the buoyancy device 100 returns to the configuration illustrated in FIG. 2. The change in shape of the C-shaped structure 280 changes the internal volume of the void 270 and therefore changes the buoyancy.

If the C-shaped structure 280 has a higher coefficient of thermal expansion less than the bell-shaped wall 260; the heating and expansion process is reversed. In this case, FIG. 2 represents the configuration where the device has been heated and FIG. 3 represents the configuration where the device has been cooled (or allowed to cool through heat transfer to the environment).

In order for the volume of the buoyancy device 100 to change as a shape of the bell-shaped wall 260 changes; the matter in the void 270 must be compressible, such as a gas. Internal pressures develop as the variable buoyancy cell 200 changes volume. Maximizing the compressibility of the gas in the void 270 will improve performance. A void 270 completely evacuated of gas will have optimal performance. The capacity of the heating element 240 and amount of control current as well as the amount of insulation govern the rates of heating and cooling and thus the speed of the system response.

The thicknesses of the C-shaped structure 280 and the bell-shaped walls 260 as well as the shape of the C-shaped structure and the bell-shaped walls in the unperturbed condition is based on a range of operating pressures and a desired amount of buoyancy change for a selected current and gain (effective change of buoyancy with applied current input). These selections can be made by following engineering practices known in the art. Electrical control circuits well known in the art monitor the ambient pressure and modify drive current to control the variable buoyancy cell 200.

In light of the above, it is therefore understood that within the scope of the appended claims, the invention may be practiced otherwise than as specifically described.

What is claimed is:

1. A thermally controlled buoyancy device comprising:

a first shell having a concave inner surface and a convex outer surface and with a first coefficient of thermal expansion and said first shell having a thickness, a cross sectional shape of a portion of a symmetric bell curve, a longitudinal extent, a first flattened end, a second flattened end and a peripheral edge in a plane;

a second shell having an inner concave surface and an outer convex surface and with a second coefficient of thermal expansion, said second shell having thickness, a cross sectional shape of a circular arc with a center of symmetry and a longitudinal extent, the inner surface of said second shell bonded to the outer surface of said first shell, said second shell aligned longitudinally with said first shell and said center of symmetry of said first shell aligned with the center of symmetry of said second shell;

a third shell having a concave inner surface and a convex outer surface and with the first coefficient of thermal expansion, said third shell having thickness, a cross sectional shape of a portion of a symmetric bell curve with a center of symmetry, a longitudinal extent, a first flattened end, a second flattened end, and a peripheral edge lying in a plane, said third shell positioned with said concave inner surface of said third shell facing said concave inner surface of said first shell with said peripheral edge of said third shell bonded to said peripheral edge of said first shell enclosing a volume between said first shell and said third shell;

a fourth shell having an inner surface and an outer surface and with the second coefficient of thermal expansion, said second shell having thickness, a cross sectional shape of a circular arc with a center of symmetry, and a longitudinal extent, the inner surface of said second shell being bonded to the outer surface of said third shell, said fourth shell aligned longitudinally with said third shell and said center of symmetry of said third shell aligned with said center of symmetry of said fourth shell; and a heating element bonded to said inner concave surface of said first shell and said inner concave surface of said third shell, said heating element electrically connected to an electrical source;

wherein said first and second shells and said third and fourth shells have a first position responsive to the temperature of said shells in which a space defined between said first and third shells is minimized and a second position responsive to the temperature of said shells in which the space defined between said second and third shells is maximized by expansion and contraction of said first shell, of said second shell, of said third shell, and of said fourth shell in response to temperature in degrees reactive to differences in coefficients of thermal expansion.

2. A thermally controlled buoyancy device in accordance with claim 1 wherein the second coefficient of expansion of said second shell and said fourth shell is greater than the first coefficient of thermal expansion of said first shell and said third shell.

3. A thermally controlled buoyancy device in accordance with claim 1 wherein the second coefficient of expansion of said second shell and said fourth shell is greater than the first coefficient of thermal expansion of said first shell and said third shell.

4. A thermally controlled buoyancy device in accordance with claim 1 wherein the electricity is provided by a depth control circuit further comprising:

a sensor reactive to external pressure; said sensor producing an electric signal; and a computer controller; said controller sampling the electric signal from said pressure sensor; said controller comparing the pressure signal to a reference; said controller producing an electric current in response to the difference in the electric signal and the reference;

wherein said computer controller is electrically connected to said heating element in said thermally controlled buoyancy device.

* * * * *